US008267469B1

(12) United States Patent
Adan

(10) Patent No.: US 8,267,469 B1
(45) Date of Patent: Sep. 18, 2012

(54) FOLDING CHAIR DEVICE

(76) Inventor: Abdulhamid F. Adan, Burke, VA (US)

( * ) Notice: Subject to any disclaimer, the term of this patent is extended or adjusted under 35 U.S.C. 154(b) by 0 days.

(21) Appl. No.: 13/178,202

(22) Filed: Jul. 7, 2011

(51) Int. Cl.
*A47C 4/00* (2006.01)

(52) U.S. Cl. ..... 297/44; 297/55

(58) Field of Classification Search ..... 297/45, 297/44, 42, 55, 58
See application file for complete search history.

(56) References Cited

U.S. PATENT DOCUMENTS

RE13,839 E * 12/1914 Zagar ..... 297/44
1,963,835 A * 6/1934 Deland ..... 297/44
2,587,543 A 2/1952 Smith
2,722,972 A 11/1955 Altruda
4,014,591 A 3/1977 Gittings
4,715,650 A * 12/1987 Berman et al. ..... 297/28
5,718,473 A 2/1998 Lynch, Jr.
6,062,648 A * 5/2000 Adler ..... 297/440.24
D432,325 S 10/2000 Zheng et al.
6,364,409 B1 * 4/2002 Saul et al. ..... 297/16.2
6,926,356 B2 8/2005 Chen
7,128,332 B2 * 10/2006 Hermes et al. ..... 280/647

* cited by examiner

*Primary Examiner* — Milton Nelson, Jr.

(57) ABSTRACT

A folding chair device having a seat that is mounted atop a seat support, wherein the bars of the seat support interconnect to form a border around the edges of the seat, with pivot mechanisms disposed in the support bars that engage the seat support, wherein the pivot mechanisms pivotally connect the support bars, having hinges disposed in the support bars allow the bottom portion to be folded upwardly, having sleeves on the support bars adapted to slide along the support bars and temporarily cover the hinges to prevent the hinges from folding, and a second frame with braces joining the sides, with pivot mechanisms in the braces which engage the side bars to pivotally connect the side braces respectively to the seat support, having hinges which allows the bottom portion to be folded upwardly or inwardly and sleeves adapted to slide and temporarily cover the hinges to prevent folding.

4 Claims, 7 Drawing Sheets

Side View

Back View

Side View- Legs Folded at Hinge

Side View- back Support and Seat Folded Toward Each Other

Back View
Legs Folded at Hinge/Back
& Seat Folded

Back View
Horizontal Hinges Folded
& Seat Support Folded In

FOLDING CHAIR DEVICE

FIELD OF THE INVENTION

The present invention is directed to a chair, more particularly to a folding chair, more particularly to a chair adapted to provide comfort to those individuals during services at mosques.

BACKGROUND OF THE INVENTION

Islam is one of the most popular religions in the world. According to one of the five pillars of Islam, prayers must be performed multiple times a day. As such, many Muslim individuals have back pain or knee pain due to sitting or kneeling on hard floor surfaces during prayers or other services in mosques (e.g., lectures). The present invention features a novel folding chair device that can provide a more comfortable prayer environment for Muslims. The folding chair device of the present invention is lightweight and easy to fold and unfold. The present invention is not limited to use in a mosque but may be used for any other purposes. For example, the chair device of the present invention may be used by individuals when traveling or by individuals with small living quarters.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a novel folding chair device 100. In some embodiments, the device 100 comprises a seat 110, a seat support 120, a first frame 210, and a second frame 310. The seat 100 has a first side edge, a second side edge, a front edge, and a back edge.

The seat support 120 comprises a first side bar 121, a second side bar 122, a front bar 123, and a back bar 124. The seat 110 is mounted atop the seat support 120. The bars 121, 122, 123, 124 of the seat support 120 interconnect to form a border around the edges of the seat 110. The front bar 123 and the back bar 124 can fold via a first seat seam 190*a* and a second seat seam 190*b*, respectively.

The first frame 210 comprises (i) a first side support bar 220*a* having a first end and a second end, a second side support bar 220*b* having a first end and a second end, a top support bar 220*c* having a first end and a second end, and a bottom support bar 220*d* having a first end and a second end, wherein the first end of the top support bar 220*c* joins the first end of the first side support bar 220*a*, the second end of the top support bar 220*c* joins the first end of the second side support bar 220*b*, the first end of the bottom support bar 220*d* joins the second end of the first side support bar 220*a*, and the second end of the bottom support bar 220*d* joins the second end of the second side support bar 220*b*; (ii) a first pivot mechanism 260*a* disposed in the first side support bar 220*a* and a second pivot mechanism 260*b* disposed in the second side support bar 220*b*, wherein the first pivot mechanism 260*b* engages the first side bar 121 of the seat support 120, and the second pivot mechanism engages the second side bar 122 of the seat support 120, wherein the first pivot mechanism 260*a* and second pivot mechanism 260*b* pivotally connect the first side support bar 220*a* and the second side support bar 220*b*, respectively, to the seat support 120; (iii) a first hinge 230*a* disposed in the first side support bar 220*a* below the first pivot mechanism 260*a* dividing the first side support bar 220*a* into a bottom portion and a top portion, wherein the first hinge 230*a* allows the bottom portion to be folded upwardly in the direction of the top portion; a first sleeve 240*a* disposed on the first side support bar 220*a* adapted to slide along the first side support bar 220*a* and temporarily cover the first hinge 230*a* to prevent the first hinge 230*a* from folding; (v) a second hinge 230*b* disposed in the second side support bar 220*b* below the second pivot mechanism 260*b* dividing the second side support bar 220*b* into a bottom portion and a top portion, wherein the second hinge 230*b* allows the bottom portion to be folded upwardly in the direction of the top portion; (vi) a second sleeve 240*b* disposed on the second side support bar 220*b* adapted to slide along the second side support bar 220*b* and temporarily cover the second hinge 230*b* to prevent the second hinge 230*b* from folding; (vii) a third hinge 230*c* disposed in the top support bar 220*c*, wherein the third hinge allows the top support bar 220*c* to be folded such that the third hinge 230*c* moves inwardly in the direction of the bottom support bar 220*d*; (viii) a third sleeve 240*c* disposed on the top support bar 220*c* adapted to slide along the top support bar 220*c* and temporarily cover the third hinge 230*c* to prevent the third hinge 230*c* from folding; (ix) a fourth hinge 230*d* disposed in the bottom support bar 220*d*, wherein the fourth hinge 230*d* allows the bottom support bar 220*d* to be folded such that the fourth hinge 230*d* moves inwardly in the direction of the top support bar 220*c*; and a fourth sleeve 240*d* disposed on the bottom support bar 220*d* adapted to slide along the bottom support bar 220*d* and temporarily cover the fourth hinge 230*d* to prevent the fourth hinge 230*d* from folding.

The second frame 310 comprises (i) a first side brace 320*a* having a first end and a second end, a second side brace 320*b* having a first end and a second end, and a bottom brace 320*c* having a first end and a second end, wherein the first end of the bottom brace 320*c* joins the second end of the first side brace 320*a* and the second end of the bottom brace 320*c* joins the second end of the second side brace 320*b*; (ii) a third pivot mechanism 260*c* disposed in the first side brace 320*a* and a fourth pivot mechanism 260*d* disposed in the second side brace 320*b*, wherein the third pivot mechanism 260*c* engages the first side bar 121 of the seat support 120 near the back bar 124 and the fourth pivot mechanism 260*d* engages the second side bar 122 of the seat support 120 near the back bar 124, wherein the third pivot mechanism 260*c* and fourth pivot mechanism 260*d* pivotally connect the first side brace 320*a* and the second side brace 320*b*, respectively, to the seat support 120; (iii) a fifth hinge 230*e* disposed in the first side brace 320*a* below the third pivot mechanism 260*c* dividing the first side brace 320*a* into a bottom portion and a top portion, wherein the fifth hinge 230*e* allows the bottom portion to be folded upwardly in the direction of the top portion; (iv) a fifth sleeve 240*e* disposed on the first side brace 320*a* adapted to slide along the first side brace 320*a* and temporarily cover the fifth hinge 230*e* to prevent the fifth hinge 230*e* from folding; (v) a sixth hinge 230*f* disposed in the second side brace 320*b* of the second frame 310 below the fourth pivot mechanism 260*d* dividing the second side brace 320*b* into a bottom portion and a top portion, wherein the sixth hinge 230*f* allows the bottom portion to be folded upwardly in the direction of the top portion; (vi) a sixth sleeve 240*f* disposed on the second side brace 320*b* adapted to slide along the second side brace 320*b* and temporarily cover the sixth hinge 230*f* to prevent the sixth hinge 230*f* from folding; (vii) a seventh hinge 230*g* disposed in the bottom brace 320*c* of the second frame 310, wherein the seventh hinge 230*g* allows the bottom brace 320*c* to be folded such that the seventh hinge 230*g* moves inwardly in the direction of the seat 110; (viii) a seventh sleeve 240*g* disposed on the bottom brace 320*c* adapted to slide along the bottom brace 320*c* and temporarily cover the seventh hinge 230*g* to prevent the seventh hinge 230*g* from folding; (ix) an eighth hinge 230*h* connecting the first end of the first side brace 230*a* to the first side support bar 220*a* above the first pivot mechanism 260*a*; and (x) a ninth hinge 230*i* connecting the first end of the second side brace 320*b* to the second side support bar 220*b* above the second pivot mechanism 260*b*.

The chair device 100 can move between at least an unfolded position wherein the first hinge 230*a*, the second hinge 230*b*, the third hinge 230*c*, the fourth hinge 230*d*, the fifth hinge 230*e*, the sixth hinge 230*f*, the seventh hinge 230*g*, the first seat seam 190*a* and the second seat seam 190*b* are not folded (e.g., FIG. 1), and a folded position wherein the first hinge 230*a*, the second hinge 230*b*, the third hinge 230*c*, the fourth hinge 230*d*, the fifth hinge 230*e*, the sixth hinge 230*f*, the seventh hinge 230*g*, the first seat seam 190*a*, and the second seat seam 190*b* are folded (e.g., FIG. 7).

DESCRIPTION OF PREFERRED EMBODIMENTS

Figure 1:
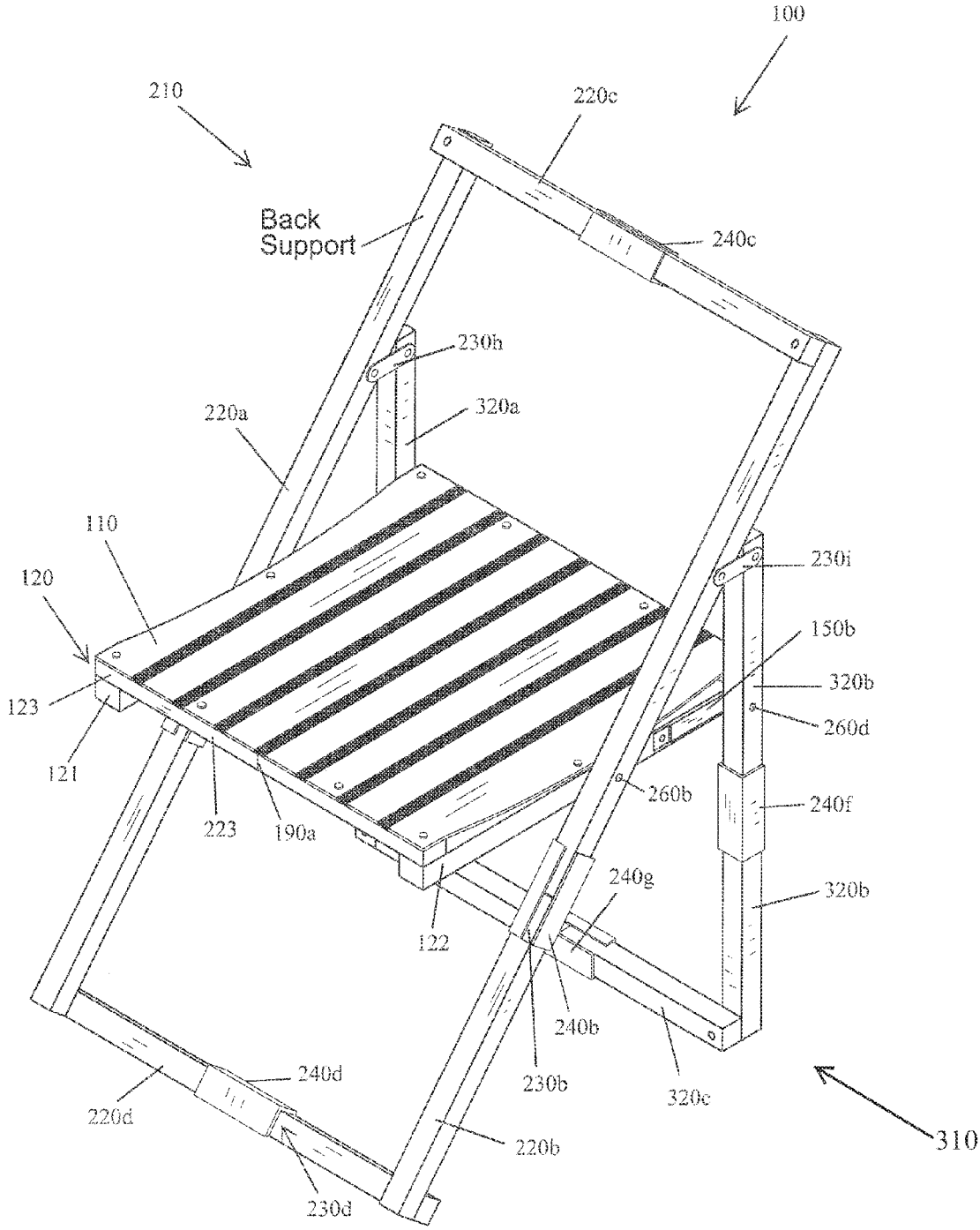
FIG. 1 is a perspective view of the folding chair device of the present invention.
Figure 2:
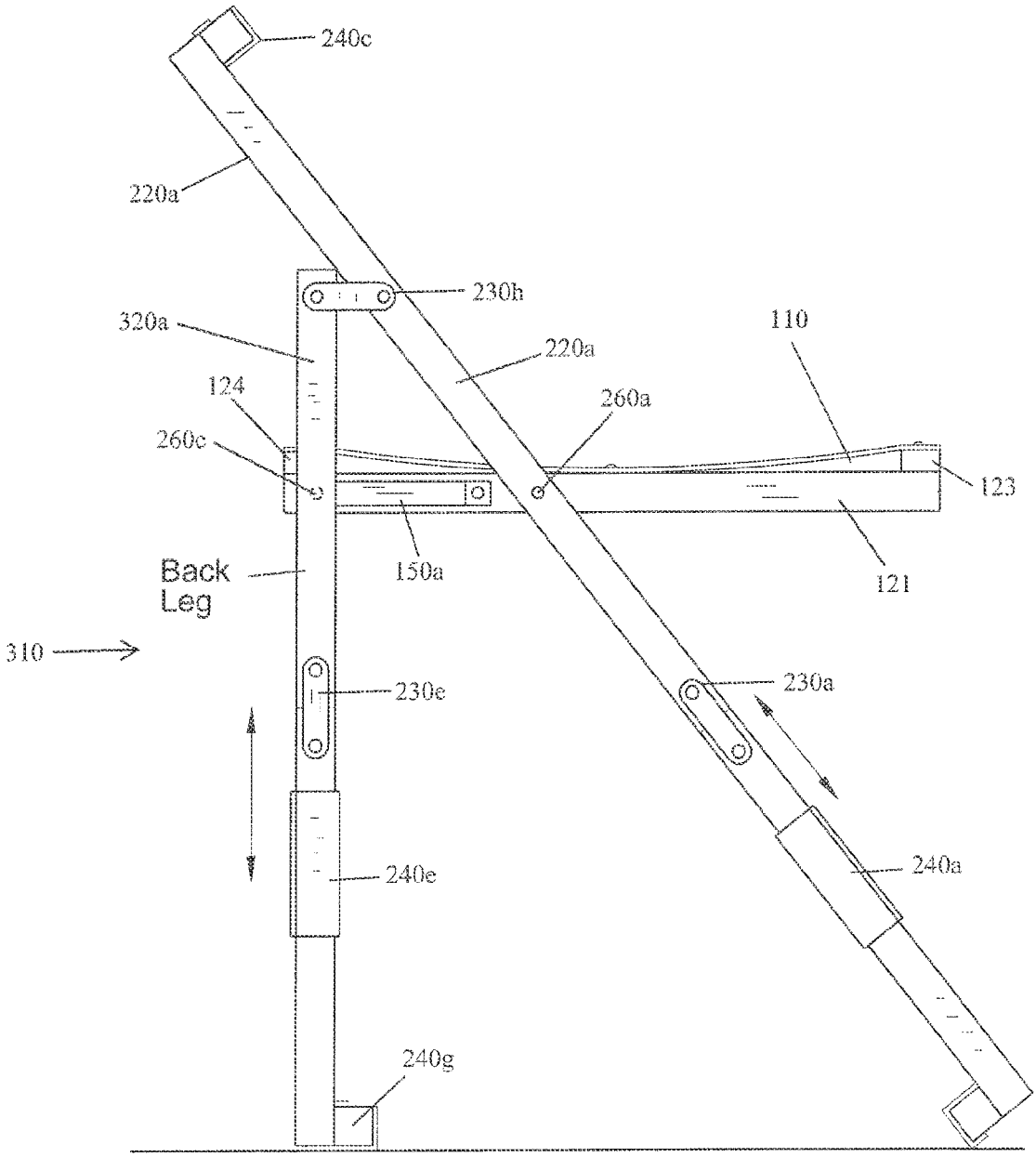
FIG. 2 is a side view of the folding chair device of the present invention.
Figure 3:
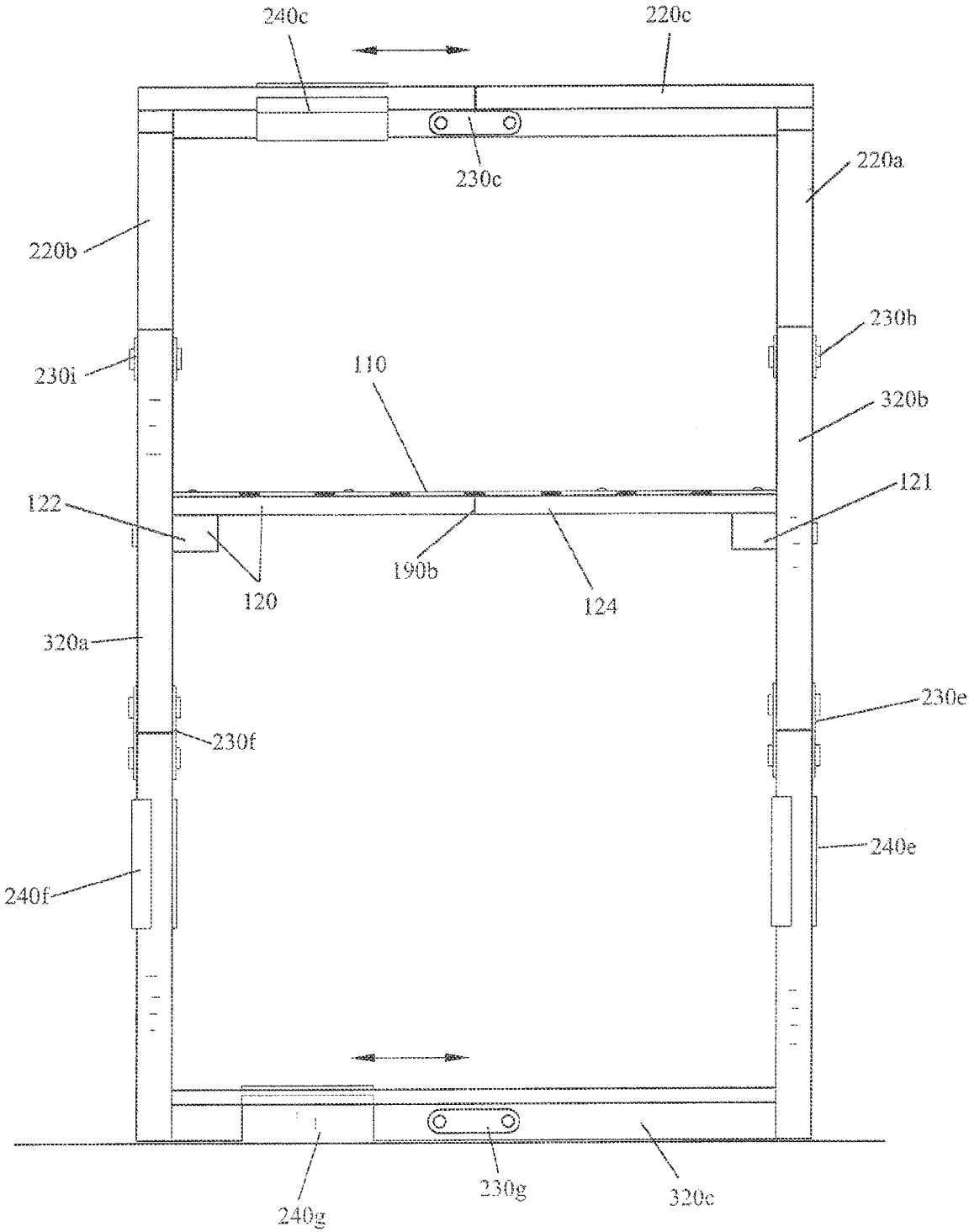
FIG. 3 is a back view of the folding chair device of the present invention.

Referring now to FIGS. 1-7, the present invention features a novel folding chair device that can provide a more comfortable prayer environment for Muslims. The chair device 100 can move between multiple positions including but not limited to an unfolded position (e.g., see FIG. 1) and a folded position (e.g., see FIG. 7).

The folding chair device 100 comprises a seat 110 having a top surface, a bottom surface, a first side edge, a second side edge, a front edge, and a back edge.

The seat 110 is mounted atop a seat support 120. In some embodiments, the seat support 120 has a first side bar 121, a second side bar 122, a front bar 123, and a back bar 124 that together form a border around the edges of the seat 110 (e.g., on the bottom surface of the seat 110). The front bar 123 and the back bar 124 can fold via a first seat seam 190*a* and a second seat seam 190*b*, respectively (see FIG. 7).

The folding chair device 100 further comprises a first frame 210. The first frame 210 is generally rectangular in shape, however the first frame 210 is not limited to this shape. The first frame 210 comprises a first side support bar 220*a* having a first end and a second end, a second side support bar 220*b* having a first end and a second end, a top support bar 220*c* having a first end and a second end, and a bottom support bar 220*d* having a first end and a second end. Together, the support bars 220 form the first frame 210 (e.g., the first end of the top support bar 220*c* pivotally joins the first end of the first side support bar 220*a*, the second end of the top support bar 220*c* pivotally joins the first end of the second side support bar 220*b*, the first end of the bottom support bar 220*d* pivotally joins the second end of the first side support bar 220*a*, the second end of the bottom support bar 220*d* pivotally joins the second end of the second side support bar 220*b*). The top support bar 220*c* and top portions of the side support bars 220*a*, 220*b* provide back support to a user. The bottom support bar 220*d* and bottom portions of the side support bars 220*a*, 220*b* function as front legs for the chair device 100.

The first frame 210 is pivotally attached to the seat support 120. For example, a first pivot mechanism 260*a* is disposed on the first side support bar 220*a* and a second pivot mechanism 260*b* is disposed on the second side support bar 220*b*. The first pivot mechanism engages the first side bar 121 of the seat support 120 and the second pivot mechanism engages the second side bar 122 of the seat support 120.

A first hinge 230*a* is disposed in the first side support bar 220*a* of the first frame 210, for example below the first pivot mechanism 260*a*, about halfway between the first end and the second end of the first side support bar 220*a*, near the first end of the first side support bar 220*a*, near the second end of the first side support bar 220*a*, etc. The first hinge 230*a* divides the first side support bar 220*a* into a bottom portion and a top portion. The first hinge 230*a* allows the bottom portion of the first side support bar 220*a* to be folded upwardly in the direction of the top portion of the first side support bar 220*a* (e.g., see FIG. 4). In some embodiments, a first sleeve 240*a* is disposed on the first side support bar 220*a* of the first frame 210. The first sleeve 240*a* is adapted to slide along the first side support bar 220*a* and temporarily cover the first hinge 230*a*. When the first sleeve 240*a* covers the first hinge 230*a*, the first sleeve 240*a* prevents the first hinge 230*a* from folding.

A second hinge 230*b* is disposed in the second side support bar 220*b* of the first frame 210, for example below the second pivot mechanism 260*b*, about halfway between the first end and the second end of the second side support bar 220*b*, near the first end of the second side support bar 220*b*, near the second end of the second side support bar 220*b*, etc. The second hinge 230*b* divides the second side support bar 220*b* into a bottom portion and a top portion. The second hinge 230*b* allows the bottom portion of the second side support bar 220*b* to be folded upwardly in the direction of the top portion of the second side support bar 220*b*. In some embodiments, a second sleeve 240*b* is disposed on the second side support bar 220*b* of the first frame 210. The second sleeve 240*b* is adapted to slide along the second side support bar 220*b* and temporarily cover the second hinge 230*b*. When the second sleeve 240*b* covers the second hinge 230*b*, the second sleeve 240*b* prevents the second hinge 230*b* from folding.

A third hinge 230*c* is disposed in the top support bar 220*c* of the first frame 210, for example about halfway between the first end and the second end of the top support bar 220*c*, near the first end of the top support bar 220*c*, near the second end of the top support bar 220*c*, etc. The third hinge 230*c* allows the top support bar 220*c* to be folded, for example the third hinge 230*c* moves inwardly in the direction of the bottom support bar 220*d* and the first end of the top support bar 220*c* moves toward the second end of the top support bar 220*c*. In some embodiments, a third sleeve 240*c* is disposed on the top support bar 220*c* of the first frame 210. The third sleeve 240*c* is adapted to slide along the top support bar 220*c* and temporarily cover the third hinge 230*c*. When third sleeve 240*c* covers the third hinge 230*c*, the third sleeve 240*c* prevents the third hinge 230*c* from folding.

A fourth hinge 230*d* is disposed in the bottom support bar 220*d* of the first frame 210, for example about halfway between the first end and the second end of the bottom support bar 220*d*, near the first end of the bottom support bar 220*d*, near the second end of the bottom support bar 220*d*, etc. The fourth hinge 230*d* allows the bottom support bar 220*d* to be folded, for example the fourth hinge 230*d* moves inwardly in the direction of the top support bar 220*c* and the first end of the bottom support bar 220*d* moves toward the second end of the bottom support bar 220*d*. In some embodiments, a fourth sleeve 240*d* is disposed on the bottom support bar 220*d* of the first frame 210. The fourth sleeve 240*d* is adapted to slide along the bottom support bar 220*d* and temporarily cover the fourth hinge 230*d*. When the fourth sleeve 240*d* covers the fourth hinge 230*d*, the fourth sleeve 240*d* prevents the fourth hinge 230*d* from folding.

The folding chair device 100 further comprises a second frame 310. The second frame 310 is generally U-shaped, however the second frame 310 is not limited to this shape. The second frame 310 comprises a first side brace 320*a* having a first end and a second end, a second side brace 320*b* having a first end and a second end, and a bottom brace 320*c* having a first end and a second end. The first end of the bottom brace 320*c* pivotally joins the second end of the first side brace 320*a* and the second end of the bottom brace 320*c* pivotally joins the second end of the second side brace 320*b*. The second frame 310 functions as back legs for the chair device 100.

A third pivot mechanism 260*c* is disposed in the first side brace 320*a* and a fourth pivot mechanism 260*d* is disposed in the second side brace 320*b*. The third pivot mechanism 260*c* engages the first side bar 121 of the seat support 120 (e.g., near the back bar 124) and the fourth pivot mechanism 260*d* engages the second side bar 122 of the seat support 120 (near the back bar 124). In some embodiments, the third pivot mechanism 260*c* engages the first side bar 121 of the seat support 120 (e.g., near the back bar 124) via a first seat connection hinge 150*a*, and the fourth pivot mechanism 260*d* engages the second side bar 122 of the seat support 120 (near the back bar 124) via a second seat connection hinge 150*b*.

The first end of the first side brace 320*a* is attached to the first side support bar 220*a* (above the first pivot mechanism 260*a*) via an eighth hinge 230*h*. The first end of the second side brace 320*b* is attached to the second side support bar 220*b* (above the second pivot mechanism 260*b*) via a ninth hinge 230.

A fifth hinge 230*e* is disposed in the first side brace 320*a* of the second frame 310, for example below the third pivot mechanism 260*c*. The fifth hinge 230*e* divides the first side brace 320*a* into a bottom portion and a top portion. The fifth hinge 230*e* allows the bottom portion of the first side brace 320*a* to be folded upwardly in the direction of the top portion of the first side brace 320*a* (e.g., see FIG. 4). In some embodiments, a fifth sleeve 240*e* is disposed on the first side brace 320*a*. The fifth sleeve 240*e* is adapted to slide along the first side brace 320*a* and temporarily cover the fifth hinge 230*e*. When the fifth sleeve 240*e* covers the seventh hinge 230*g*, the fifth sleeve 240*e* prevents the fifth hinge 230*e* from folding.

A sixth hinge 230*f* is disposed in the second side brace 320*b* of the second frame 310, for example below the fourth pivot mechanism 260*d*. The sixth hinge 230*f* divides the second side brace 320*b* into a bottom portion and a top portion. The sixth hinge 230*f* allows the bottom portion of the second side brace 320*b* to be folded upwardly in the direction of the top portion of the second side brace 320*b*. In some embodiments, a sixth sleeve 240*f* is disposed on the second side brace 320*b*. The sixth sleeve 240*f* is adapted to slide along the second side brace 320*b* and temporarily cover the sixth hinge 230*f*. When the sixth sleeve 240*f* covers the sixth hinge 230*f*, the sixth sleeve 240*f* prevents the sixth hinge 230*f* from folding.

A seventh hinge 230*g* is disposed in the bottom brace 320*c* of the second frame 310, for example about halfway between the first end and the second end of the bottom brace 320*c*, near the first end of the bottom brace 320*c*, near the second end of the bottom brace 320*c*, etc. The seventh hinge 230*g* allows the bottom brace 320*c* to be folded, for example the seventh hinge 230*g* moves inwardly in the direction of the seat 110 and the first end of the bottom brace 320*c* moves toward the second end of the bottom brace 320*c*. In some embodiments, a seventh sleeve 240*g* is disposed on the bottom brace 320*c*. The seventh sleeve 240*g* is adapted to slide along the bottom brace 320*c* and temporarily cover the seventh hinge 230*g*. When seventh sleeve 240*g* covers the seventh hinge 230*g*, the seventh sleeve 240*g* prevents the seventh hinge 230*g* from folding.

Figure 4:
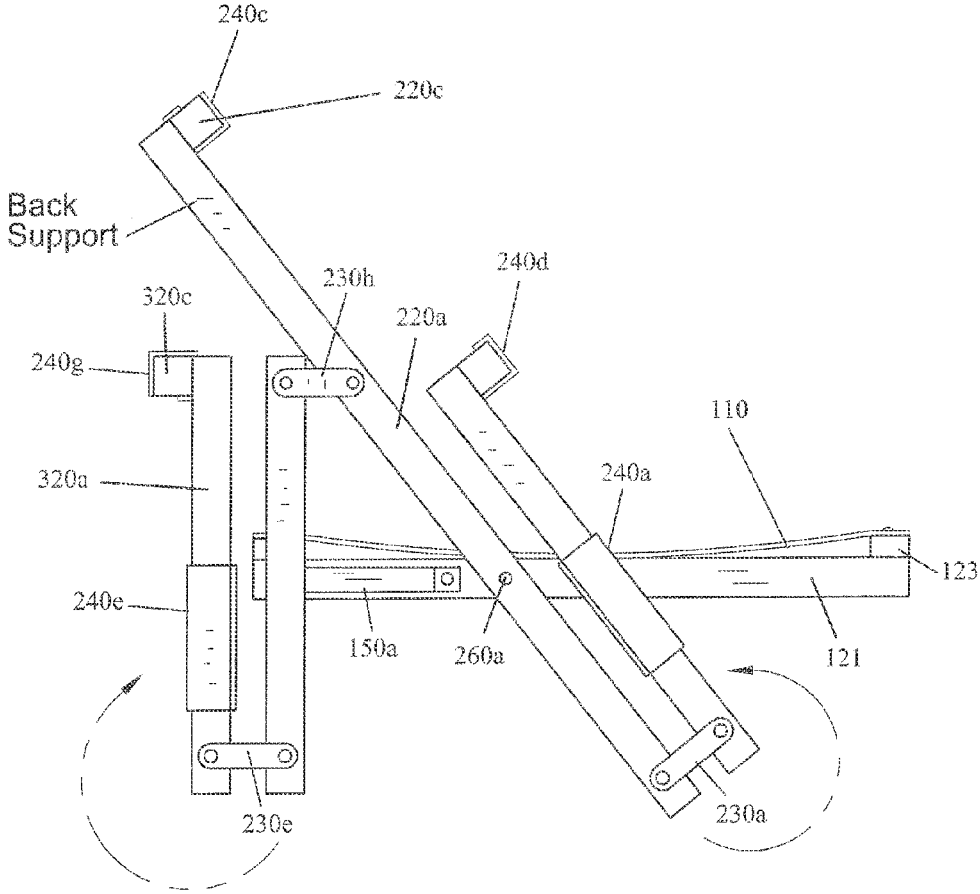
FIG. 4 is a side view of the folding chair device of the present invention, wherein the side support bars and the side braces are folded at the hinges.
Figure 5:
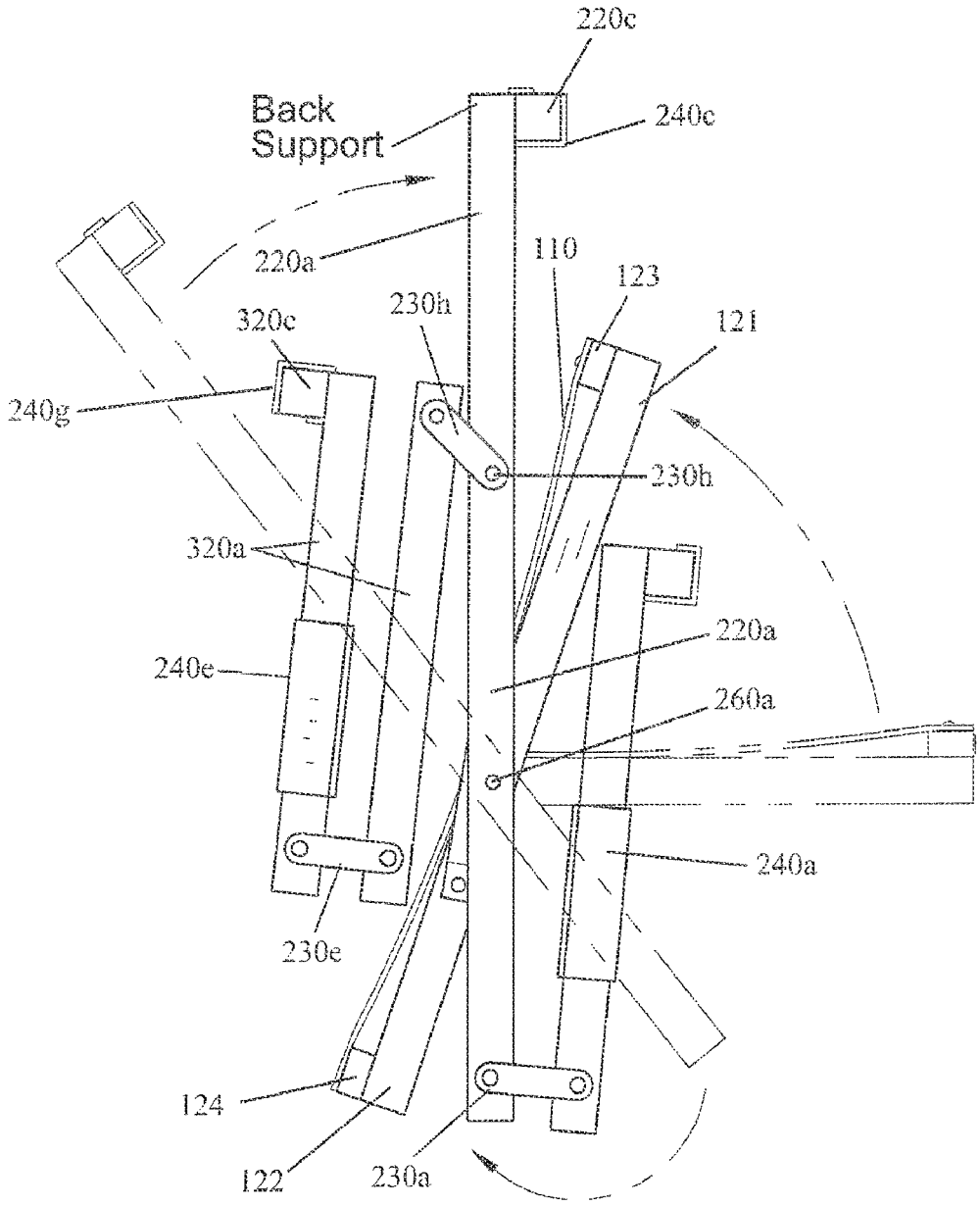
FIG. 5 is a side view of the folding chair device of the present invention, wherein the side support bars and the side braces are folded at the hinges and the top support bar and the seat are folded toward each other.
Figure 6:
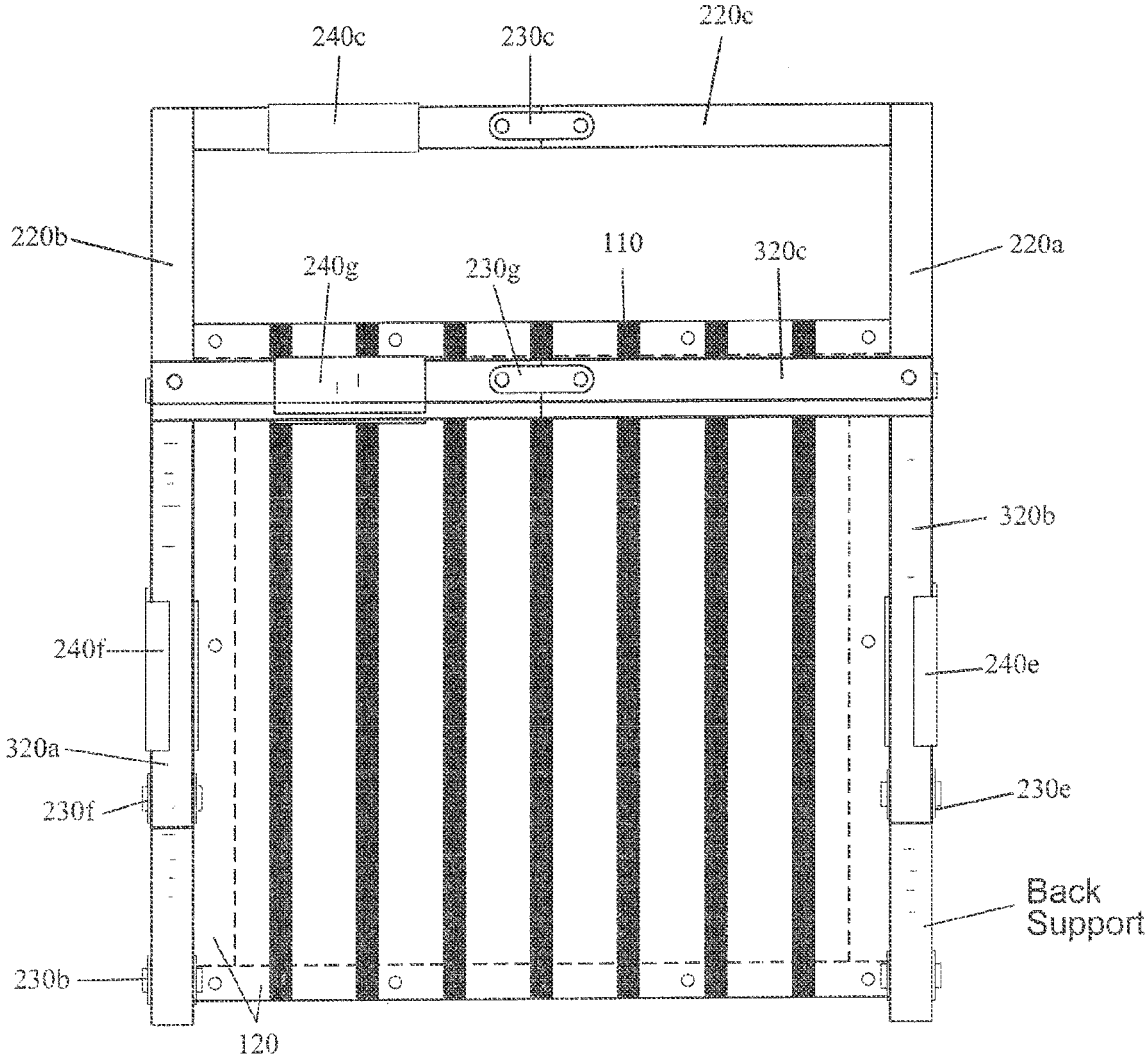
FIG. 6 is a back view of the folding chair device of the present invention, wherein the side support bars and the side braces are folded at the hinges and the top support bar and the seat are folded toward each other.
Figure 7:
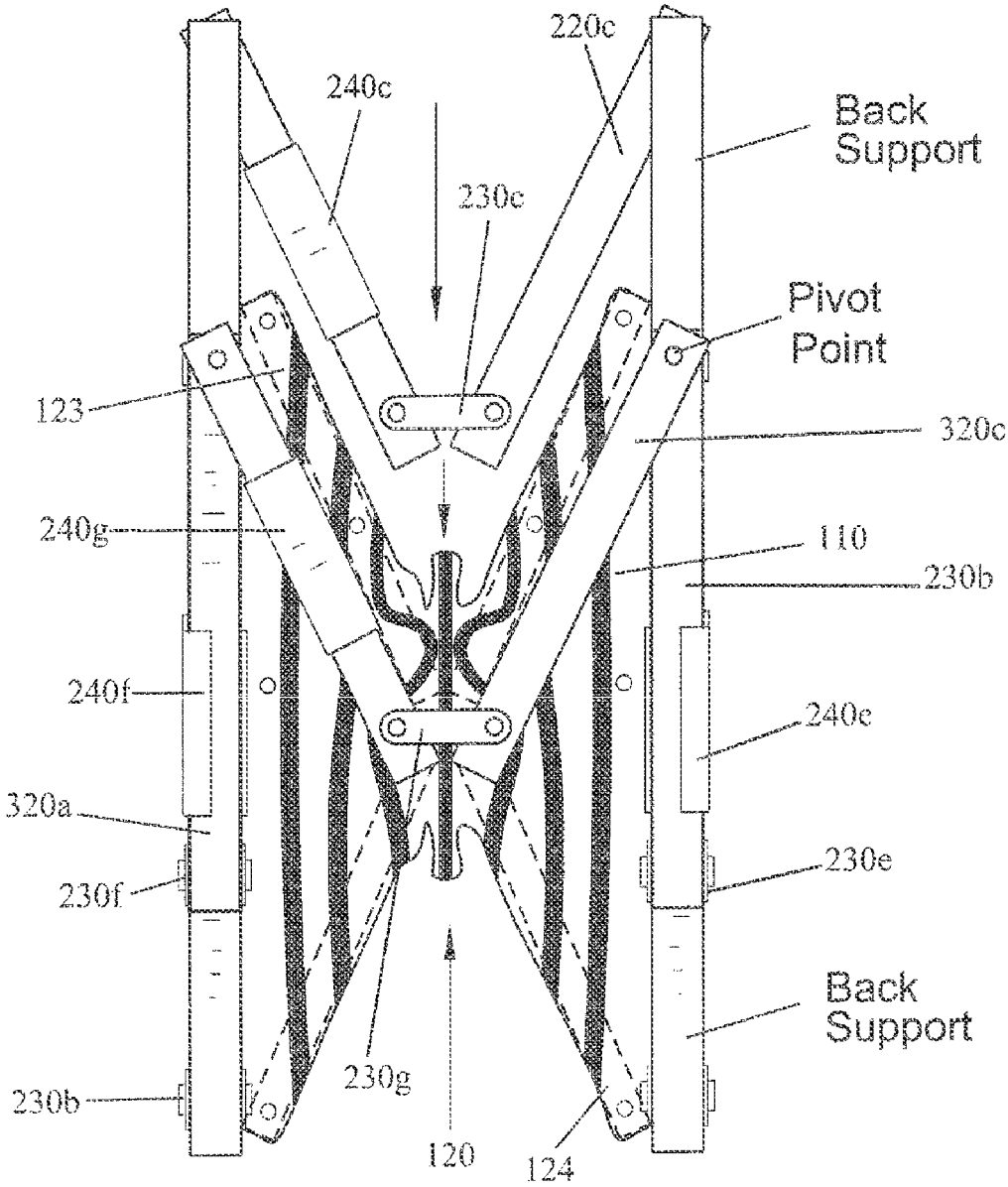
FIG. 7 is a back view of the folding chair device of the present invention, wherein the side support bars and the side braces are folded at the hinges, the top support bar and the seat are folded toward each other, and the hinges in the top support bar and bottom support bar are folded.

The chair device 100 can move between multiple positions including but not limited to an unfolded position (e.g., see FIGS. 1-3) and a folded position (e.g., see FIG. 7). As shown in FIG. 4, the first side support bar 220*a* and the second side support bar 220*b* can be folded via the first hinge 240*a* and the second hinge 240*b*, respectively. The first side brace 320*a* and the second side brace 320*b* can be folded via the fifth hinge 240*e* and the sixth hinge 240*f*, respectively. As shown in FIG. 5, the top portions of the side support bars 220 and the top support bar 220*c* can be moved toward the seat 110 (e.g., the front bar 123 of the seat 110). As shown in FIG. 7, the top support bar 220*c*, the bottom support bar 220*d*, and the bottom brace 320*c* can be folded via the third hinge 240*c*, the fourth hinge 240*d*, and the seventh hinge 240*g*, respectively.

The chair device 100 of the present invention may be constructed from a variety of materials. For example, in some embodiments, the seat 110 is constructed from a material comprising canvas. In some embodiments, the first frame 210 and the second frame 310 are constructed from a material comprising wood, plastic, metal, the like, or a combination thereof. The present invention is not limited to the aforementioned materials.

As used herein, the term "about" refers to plus or minus 10% of the referenced number. For example, an embodiment wherein the first side support bar is about 5 feet in length includes a first side support bar that is between 4.5 and 5.5 feet in length.

The disclosures of the following U.S. patents are incorporated in their entirety by reference herein: U.S. Pat. No. 4,014,591; U.S. Pat. No. 2,587,543; U.S. Design Pat. No. D432,325; U.S. Pat. No. 6,926,356; U.S. Pat. No. 5,718,473; U.S. Pat. No. 2,722,972.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A novel folding chair device (100) comprising:

(a) a seat (110) having a first side edge, a second side edge, a front edge, and a back edge;

(b) a seat support (120) comprising a first side bar (121), a second side bar (122), a front bar (123), and a back bar (124), the seat (110) is mounted atop the seat support (120), the bars (121), (122), (123), (124) of the seat support (120) interconnect to form a border around the edges of the seat (110), the front bar (123) and the back bar (124) can fold via a first seat seam (190*a*) and a second seat seam (190*b*), respectively;

(c) a first frame (210) comprising (i) a first side support bar (220*a*) having a first end and a second end, a second side support bar (220*b*) having a first end and a second end, a top support bar (220*c*) having a first end and a second end, and a bottom support bar (220*d*) having a first end and a second end, wherein the first end of the top support bar (220*c*) joins the first end of the first side support bar (220*a*), the second end of the top support bar (220*c*) joins the first end of the second side support bar (220*b*), the first end of the bottom support bar (220*d*) joins the second end of the first side support bar (220*a*), and the second end of the bottom support bar (220*d*) joins the second end of the second side support bar (220*b*);

(ii) a first pivot mechanism (260*a*) disposed in the first side support bar (220*a*) and a second pivot mechanism (260*b*) disposed in the second side support bar (220*b*), the first pivot mechanism (260*b*) engages the first side bar (121) of the seat support (120), and the second pivot mechanism engages the second side bar (122) of the seat support (120), the first pivot mechanism (260*a*) and second pivot mechanism (260*b*) pivotally connect the first side support bar (220*a*) and the second side support bar (220*b*), respectively, to the seat support (120);

(iii) a first hinge (230*a*) disposed in the first side support bar (220*a*) below the first pivot mechanism (260*a*) dividing the first side support bar (220*a*) into a bottom portion and a top portion, the first hinge (230*a*) allows the bottom portion to be folded upwardly in the direction of the top portion;

(iv) a first sleeve (240*a*) disposed on the first side support bar (220*a*) adapted to slide along the first side support bar (220*a*) and temporarily cover the first hinge (230*a*) to prevent the first hinge (230*a*) from folding;

(v) a second hinge (230*b*) disposed in the second side support bar (220*b*) below the second pivot mechanism (260*b*) dividing the second side support bar (220*b*) into a bottom portion and a top portion, the second hinge (230*b*) allows the bottom portion to be folded upwardly in the direction of the top portion;

(vi) a second sleeve (240*b*) disposed on the second side support bar (220*b*) adapted to slide along the second side support bar (220*b*) and temporarily cover the second hinge (230*b*) to prevent the second hinge (230*b*) from folding;

(vii) a third hinge (230*c*) disposed in the top support bar (220*c*), the third hinge allows the top support bar (220*c*) to be folded such that the third hinge (230*c*) moves inwardly in the direction of the bottom support bar (220*d*);

(viii) a third sleeve (240*c*) disposed on the top support bar (220*c*) adapted to slide along the top support bar (220*c*) and temporarily cover the third hinge (230*c*) to prevent the third hinge (230*c*) from folding;

(ix) a fourth hinge (230*d*) disposed in the bottom support bar (220*d*), the fourth hinge (230*d*) allows the bottom support bar (220*d*) to be folded such that the fourth hinge (230*d*) moves inwardly in the direction of the top support bar (220*c*); and (x) a fourth sleeve (240*d*) disposed on the bottom support bar (220*d*) adapted to slide along the bottom support bar (220*d*) and temporarily cover the fourth hinge (230*d*) to prevent the fourth hinge (230*d*) from folding;

(d) a second frame (310) comprising:

(i) a first side brace (320*a*) having a first end and a second end, a second side brace (320*b*) having a first end and a second end, and a bottom brace (320*c*) having a first end and a second end, wherein the first end of the bottom brace (320*c*) joins the second end of the first side brace (320*a*) and the second end of the bottom brace (320*c*) joins the second end of the second side brace (320*b*);

(ii) a third pivot mechanism (260*c*) disposed in the first side brace (320*a*) and a fourth pivot mechanism (260*d*) disposed in the second side brace (320*b*) the third pivot mechanism (260*c*) engages the first side bar (121) of the seat support (120) near the back bar (124) and the fourth pivot mechanism (260*d*) engages the second side bar (122) of the seat support (120) near the back bar (124), the third pivot mechanism (260*c*) and fourth pivot mechanism (260*d*) pivotally connect the first side brace (320*a*) and the second side brace (320*b*), respectively, to the seat support (120);

(iii) a fifth hinge (230*e*) disposed in the first side brace (320*a*) below the third pivot mechanism (260*c*) dividing the first side brace (320*a*) into a bottom portion and a top portion, the fifth hinge (230*e*) allows the bottom portion to be folded upwardly in the direction of the top portion;

(iv) a fifth sleeve (240*e*) disposed on the first side brace (320*a*) adapted to slide along the first side brace (320*a*) and temporarily cover the fifth hinge (230*e*) to prevent the fifth hinge (230*e*) from folding;

(v) a sixth hinge (230*f*) disposed in the second side brace (320*b*) of the second frame (310) below the fourth pivot mechanism (260*d*) dividing the second side brace (320*b*) into a bottom portion and a top portion, the sixth hinge (230*f*) allows the bottom portion to be folded upwardly in the direction of the top portion;

(vi) a sixth sleeve (240*f*) disposed on the second side brace (320*b*) adapted to slide along the second side brace (320*b*) and temporarily cover the sixth hinge (230*f*) to prevent the sixth hinge (2300 from folding;

(vii) a seventh hinge (230*g*) disposed in the bottom brace (320*c*) of the second frame (310), the seventh hinge (230*g*) allows the bottom brace (320*c*) to be folded such that the seventh hinge (230*g*) moves inwardly in the direction of the seat (110);

(viii) a seventh sleeve (240*g*) disposed on the bottom brace (320*c*) adapted to slide along the bottom brace (320*c*) and temporarily cover the seventh hinge (230*g*) to prevent the seventh hinge (230*g*) from folding;

(ix) an eighth hinge (230*h*) connecting the first end of the first side brace (230*a*) to the first side support bar (220*a*) above the first pivot mechanism (260*a*);

(x) a ninth hinge (230*i*) connecting the first end of the second side brace (320*b*) to the second side support bar (220*b*) above the second pivot mechanism (260*b*);

wherein the chair device (100) can move between at least an unfolded position wherein the first hinge (230*a*), the second hinge (230*b*), the third hinge (230*c*), the fourth hinge (230*d*), the fifth hinge (230*e*) the sixth hinge (230*f*), the seventh hinge (230*g*), the first seat seam (190*a*) and the second seat seam (190*b*) are not folded, and a folded position wherein the first hinge (230*a*), the second hinge (230*b*), the third hinge (230*c*), the fourth hinge (230*d*), the fifth hinge (230*e*), the sixth hinge (230*f*), the seventh hinge (230*g*), the first seat seam (190*a*), and the second seat seam (190*b*) are folded.

2. The device (100) of claim 1, wherein the seat (110) is constructed from a material comprising canvas.

3. The device (100) of claim 1, wherein the first frame (210) and the second frame (310) are constructed from a material comprising wood, plastic, metal, or a combination thereof.

4. The device (100) of claim 1, wherein the third pivot mechanism (260*c*) engages the first side bar (121) of the seat support (120) via a first seat connection hinge (150*a*), and the fourth pivot mechanism (260*d*) engages the second side bar (122) of the seat support (120) via a second seat connection hinge (150*b*).

* * * * *